US011180921B2

(12) United States Patent
Culp et al.

(10) Patent No.: US 11,180,921 B2
(45) Date of Patent: Nov. 23, 2021

(54) HIDDEN FASTENER RAILING SYSTEM

(71) Applicant: eGlass, LLC, Vancouver, WA (US)

(72) Inventors: Jeremiah D. Culp, Vancouver, WA (US); Eric W. Reimer, Camas, WA (US)

(73) Assignee: eGlass, LLC, Vancouver, WA (US)

( * ) Notice: Subject to any disclaimer, the term of this patent is extended or adjusted under 35 U.S.C. 154(b) by 621 days.

(21) Appl. No.: 16/049,396

(22) Filed: Jul. 30, 2018

(65) Prior Publication Data

US 2019/0271161 A1 Sep. 5, 2019

Related U.S. Application Data

(60) Provisional application No. 62/637,697, filed on Mar. 2, 2018.

(51) Int. Cl.
*E04F 11/18* (2006.01)

(52) U.S. Cl.
CPC ..... *E04F 11/1817* (2013.01); *E04F 11/1853* (2013.01)

(58) Field of Classification Search
CPC ..... E04F 11/1817; E04F 11/1853; E04F 2011/1819; E04F 2011/1823; E04F 2011/1827; E04F 2011/1829; E04H 17/1447; E04H 17/1452; E04H 17/1482; E04H 17/1488; E04H 2017/1447; E04H 2017/1452; E04H 2017/1482
USPC ..... 256/65.02, 65.03, 65.07; 248/218.4, 248/219.2, 219.3, 219.4
See application file for complete search history.

(56) References Cited

U.S. PATENT DOCUMENTS

| | | | | |
|---|---|---|---|---|
| 7,784,239 | B2 * | 8/2010 | Mansueto | E06B 3/9681 52/656.9 |
| 8,015,766 | B2 * | 9/2011 | Gosling | E04B 2/7455 52/239 |
| 8,413,401 | B2 * | 4/2013 | Wang | A47K 3/34 52/656.9 |
| 10,876,297 | B1 * | 12/2020 | Poma | E04F 11/1853 |
| 2007/0029534 | A1 * | 2/2007 | Adderton | E04F 11/1853 256/24 |

(Continued)

FOREIGN PATENT DOCUMENTS

| | | | | |
|---|---|---|---|---|
| CA | 2200265 | A1 * | 9/1998 | E04F 11/1851 |
| CA | 2376692 | A1 * | 9/2003 | E04F 11/1817 |
| DE | 19854895 | A1 * | 6/1999 | F16B 7/18 |

(Continued)

*Primary Examiner* — Amber R Anderson
*Assistant Examiner* — Zachary A Hall
(74) *Attorney, Agent, or Firm* — Seed IP Law Group LLP

(57) ABSTRACT

A modular block toy and kit that includes a male cubic unit piece having a plurality of faces with a male node extending from each respective face of the plurality of faces, and a female piece having a plurality of faces and corners formed by three intersecting faces, the female piece having a female component formed on a respective face of each of the plurality of faces that is sized and shaped to receive a respective male node enabling connection using any side of the female piece and any side of the male piece, and in which all sides of the female and male pieces with the snapping and interlock design are identical, enabling the pieces to be snapped together using any side of the female or male piece to achieve build out indefinitely in any direction.

10 Claims, 15 Drawing Sheets

(56) References Cited

U.S. PATENT DOCUMENTS

2015/0115214 A1* 4/2015 Schneider ..... E04F 11/1844
256/67
2020/0032565 A1* 1/2020 Culp ..... E05D 7/0009

FOREIGN PATENT DOCUMENTS

EP 1640529 A1 * 3/2006 ..... E04F 11/1817
KR 20100138526 A * 12/2010

* cited by examiner

HIDDEN FASTENER RAILING SYSTEM

BACKGROUND

Technical Field

The present disclosure pertains to railings and, more particularly, to components for railings employing varied curvatures and elevational changes in which the connection hardware of the railing components is hidden from view.

Description of the Related Art

Railings are utilized in a variety of applications, including elevated porches and decks, around swimming pools, and along stairways. The railing structure typically includes a top hand rail and upright or vertical supports that hold the top rail above the ground or to a structure, such as a wall or deck. In railings employing a barrier between the vertical uprights, a bottom rail is utilized to support the barrier. The connection between the top rail, the bottom rail, and the vertical support is often done with fasteners such as screws, rivets, or bolts.

It is often desirable to have such fasteners hidden from view. This not only provides an aesthetic effect, it can protect users from scraping or catching a hand or finger on the fastener, resulting in injury, or snagging clothing on the fastener, which could cause a user to lose their footing.

A difficulty in using hidden fasteners is providing access to the fasteners during and after construction of the railing. Another issue is accommodating non-linear railings that either turn or curve in a horizontal plane, have a change in elevation, such as a stairway and landing, or both curve and have elevation changes.

Various railing systems having hidden fasteners are known. However, these systems either do not address the issue of varied linear curvatures or elevational changes at all or they fail to address these issues adequately.

BRIEF SUMMARY

The present disclosure is directed to a railing system having hidden fasteners that enables application to non-linear and corner uses as well as changing elevational environments. In accordance with one aspect of the present disclosure, a hidden fastener railing system is provided that utilizes unique stepped and stackable brackets in combination with extruded members to conceal the fasteners.

In accordance with another aspect of the present disclosure, a hidden fastener system to connect extruded posts to a top railing is provided that is structured to work for linear runs of railing, 90 degree turns, and many other angles up to and including 135 degrees.

In accordance with another aspect of the present disclosure, a railing system that employs glass panels is provided, the railing system including:

(a) at least a first post and a second post, each post having a first end capable of mounting to a support and a second end;

(b) a rail having a top side and an opposing bottom side;

(c) a mounting bracket having a base with a first half and a second half and a pair of spaced apart first and second arms extending from the base, the first arm extending from the first half of the base and the second arm extending from the second half of the base in spaced parallel relationship to the first arm, the second half of the base offset from the first half of the base a first offset distance, the second arm offset from the second half of the base by a second offset distance, and the first arm offset from the first half of the base by a third offset distance that is a sum of the first offset distance and the second offset distance so that a distal end of the first arm is coplanar with a distal end of the second arm, first and second ears extending from the first half and the second half of the base respectively, each ear having an arcuate opening, the mounting bracket sized and shaped to be mounted to the top of a first post of the plurality of posts via a fastener in at least one of the arcuate openings, the first and second arms each having an opening to receive a fastener for threadable engagement with a bottom side of the top rail;

(d) a top rail infill capable of attaching to the bottom side of the top rail and concealing the fasteners that attach the mounting bracket to the bottom side of the top rail, the top rail infill having a channel;

(e) a vinyl liner capable of attachment in the channel of the top rail infill and sized and shaped to receive an edge of a glass panel;

(f) a mounting block sized and shaped to be attached to the post with at least one fastener, the mounting block having a pair of spaced apart extensions projecting from the top side of the bottom rail; and (g) a bottom rail having a top side and an opposing bottom side, the top side having a channel sized and shaped to receive a bottom edge of the glass, and the bottom side having a pair of channels sized and shaped to be received over the pair of spaced apart extensions on the top side of the bottom rail and support the bottom rail on the mounting block, the bottom rail having a skirt extending past the bottom side of the bottom rail to conceal the at least one fastener when the railing system is assembled.

In accordance with another aspect of the present disclosure, a railing mounting system for use with a plurality of posts having a first end capable of mounting to a support and a second end, and at least one rail having a top side and an opposing bottom side is provided. The mounting system includes a mounting bracket having a base with a first half and a second half and a pair of spaced apart first and second arms extending from the base, the first arm extending from the first half of the base and the second arm extending from the second half of the base in spaced parallel relationship to the first arm, the second half of the base offset from the first half of the by base a first offset distance, the second arm offset from the second half of the base by a second offset distance, and the first arm offset from the first half of the base by a third offset distance that is a sum of the first offset distance and the second offset distance so that a distal end of the first arm is coplanar with a distal end of the second arm, first and second ears extending from the first half and the second half of the base respectively, each ear having an arcuate opening, the mounting bracket sized and shaped to be mounted to the top of a first post of the plurality of posts via a fastener in at least one of the arcuate openings, the first and second arms each having an opening to receive a fastener for threadable engagement with a bottom side of the rail.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

Figure 1:
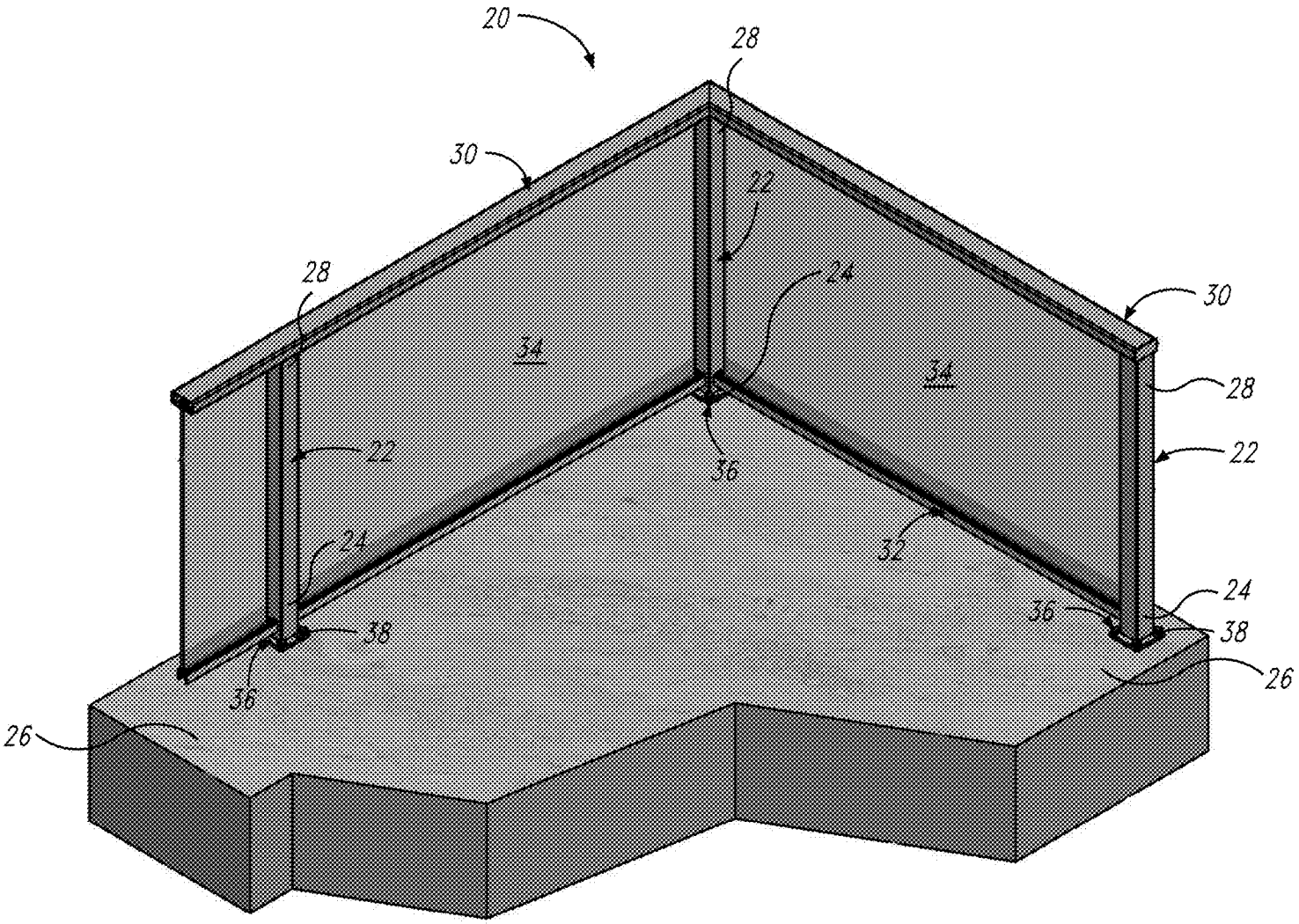
FIG. 1 is an isometric view of a flat deck railing system formed in accordance with the present disclosure.

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures or components or both associated with extruded posts, top and bottom rails, inserts, panels of glass, and fasteners or other materials and the like have not been shown or described in order to avoid unnecessarily obscuring descriptions of the various implementations of the present disclosure.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations.

The Figures are provided (a) to further describe the present disclosure, (b) to show certain implementations or permutations of the present disclosure, and (c) to show enablement, function, and use thereof. In the detailed description of the figures that follows, like elements may be referred to with the same reference number throughout the different implementations of the present disclosure.

As used herein, the term rail is intended to embrace and mean, without limitation, a bottom rail, a top rail, and a top hand rail (also referred to as a railing). Rails may be a single piece, such as wood, plastic, metal (ferrous and non-ferrous), and may be formed using a variety of processes known in the art, such as extrusion. Rails may also include guardrails along platforms, walkways, stairs, stages, balconies, roadways, walkways, trails, and the like. Rail installations may be free-standing, meaning they include their own vertical support as an integral part of the rail installation. In the present disclosure, the term rail is intended to be applied to rails that are supported by a separate support or supporting structure, such as a post, a wall, spindle, picket, baluster, banister, balustrade, or even a natural structure, such as a tree or a rock wall, to which the rail must be attached either before or at the time of installation of the railing system. Moreover, a "railing," "railing system," and "rail system" can be considered a single rail between two supports, a plurality of rails, and even a fence or barrier in which one or more panels, bars, and other components (e.g., balusters, spindles, pickets, balustrades, lattices) cooperate with the rails to form a barrier that is either opaque, translucent, or transparent.

A representative implementation described herein utilizes extruded rails, either of plastic or metal. However, it is to be understood that the present disclosure can be adapted for use with other forms of rails, including without limitation those described and referred to herein.

Referring initially to FIG. 1, shown therein is a flat deck railing system 20 formed in accordance with the present disclosure to include a plurality of support posts 22 having a first end 24 attached to a supporting structure, such as a deck 26 or patio, and a second end or top end 28 attached to a top rail 30. A bottom rail 32 spans a distance between each of the posts 22 and cooperates with the top rail 30 to hold a panel 34, such as a glass panel, in place between the posts 22. In this implementation, the posts 22 are supported on the deck 26 by base plates 36 affixed to or formed integral with the first end 24 of the posts 22 and suitable fasteners 38 for the support structure. While a deck 26 formed of concrete is shown, it is to be understood that the deck may be formed of other materials, including without limitation wood, metal, and composites.

Figure 2:
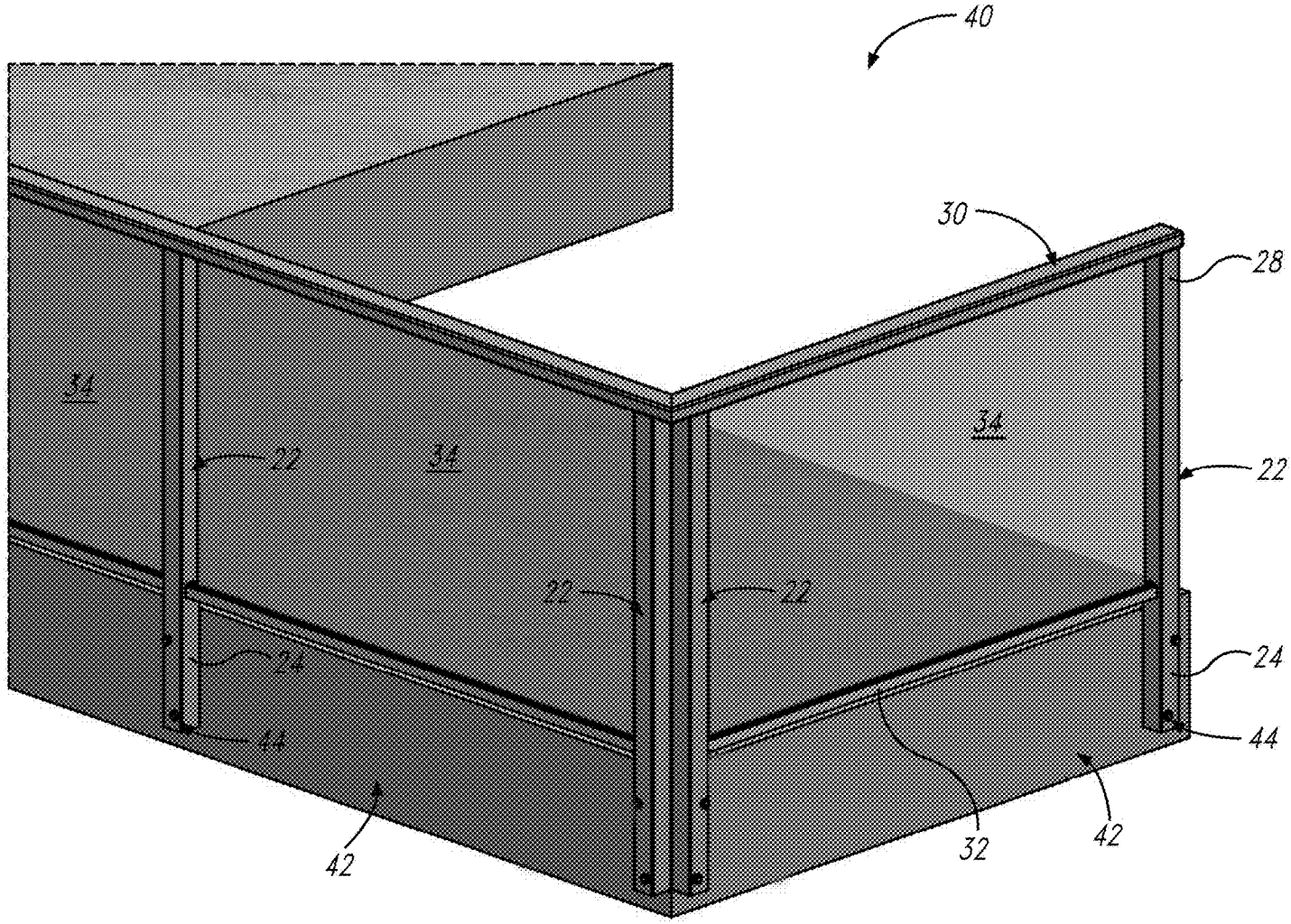
FIG. 2 is an isometric view of a fascia mount railing system formed in accordance with the present disclosure.

In FIG. 2, a fascia mount railing system 40 is shown that is nearly identical to the flat deck railing system of FIG. 1 except the posts 22 are attached to the side of the deck 26, such as to a fascia 42 with suitable fasteners 44. In this implementation no base plate 36 is used on the bottoms of the posts 22. In addition, in the flat deck implementation only one post 22 is used to form a corner whereas in the fascia mount two posts 22 are used to form a corner as shown in FIG. 2.

Figure 3:
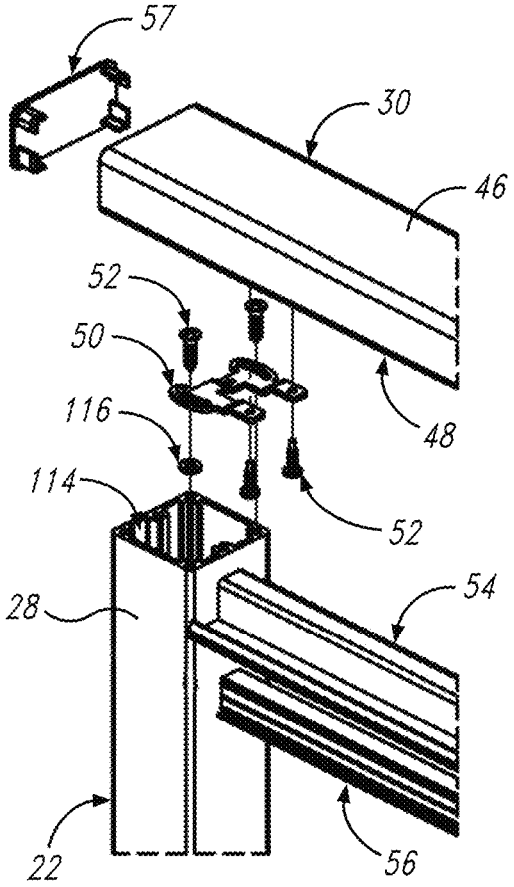
FIG. 3 is an exploded isometric view of a top rail end connection of the railing systems of FIGS. 1 and 2.

An exploded view of a top rail end connection is shown in FIG. 3. The top rail 30 has a top side 46 and a bottom side 48 that is attached to the second end 28 of the post 22 with a mounting bracket 50. As described in more detail below, two fasteners 52 attach the bracket 50 to the post 22 and two fasteners 52 attach the bracket 50 to the bottom side 48 of the top rail 30. A top rail infill 54 snaps into place on the bottom side 48 of the top rail 30 to hide the fasteners 52 from view. A top rail insert 56 fits into the top rail infill 54 with a friction or interference fit as described more fully below. An end cap 57 is pressure fit into an open end of the top rail 30.

Figure 4:
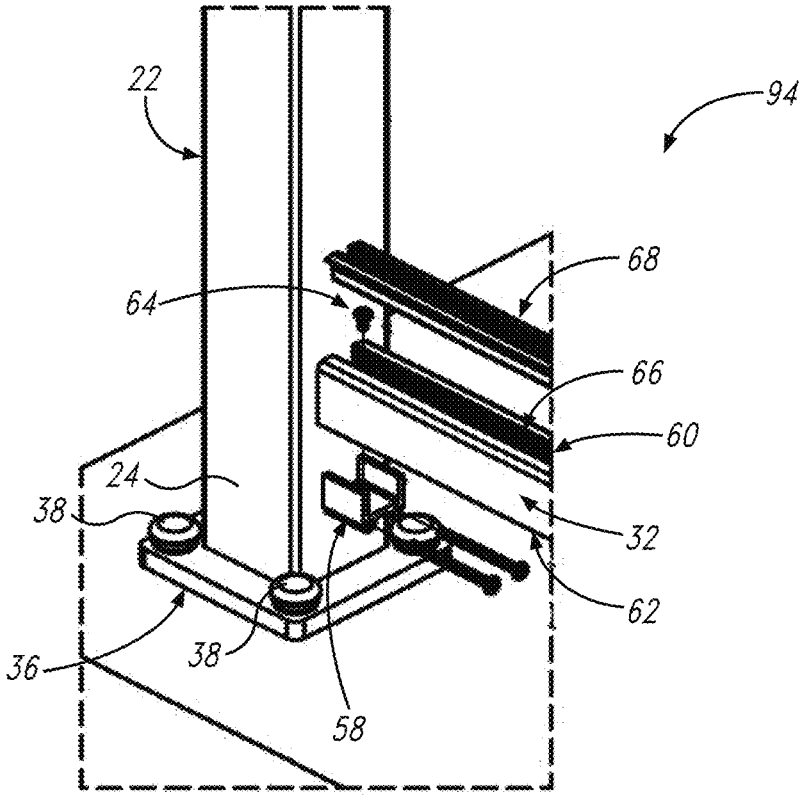
FIG. 4 is an exploded isometric view of a bottom rail end connection of the railing systems of FIGS. 1 and 2.

In FIG. 4 is shown an exploded view of the bottom rail 32 connection to the post 22. Here a rail connection block 58 is affixed to the second end 28 of the post with fasteners 52. The bottom rail 32 has a top side 60 and a bottom side 62, with the bottom side sized and shaped to rest on the rail connection block 58 and be affixed thereto with a suitable fastener 64 as described in more detail below. The top side 60 of the bottom rail 32 has a channel 66 formed that is sized and shaped to receive a bottom rail insert 68. No mounting bracket 50 is used for the bottom rail 32 connection to the post 22.

Figure 5:
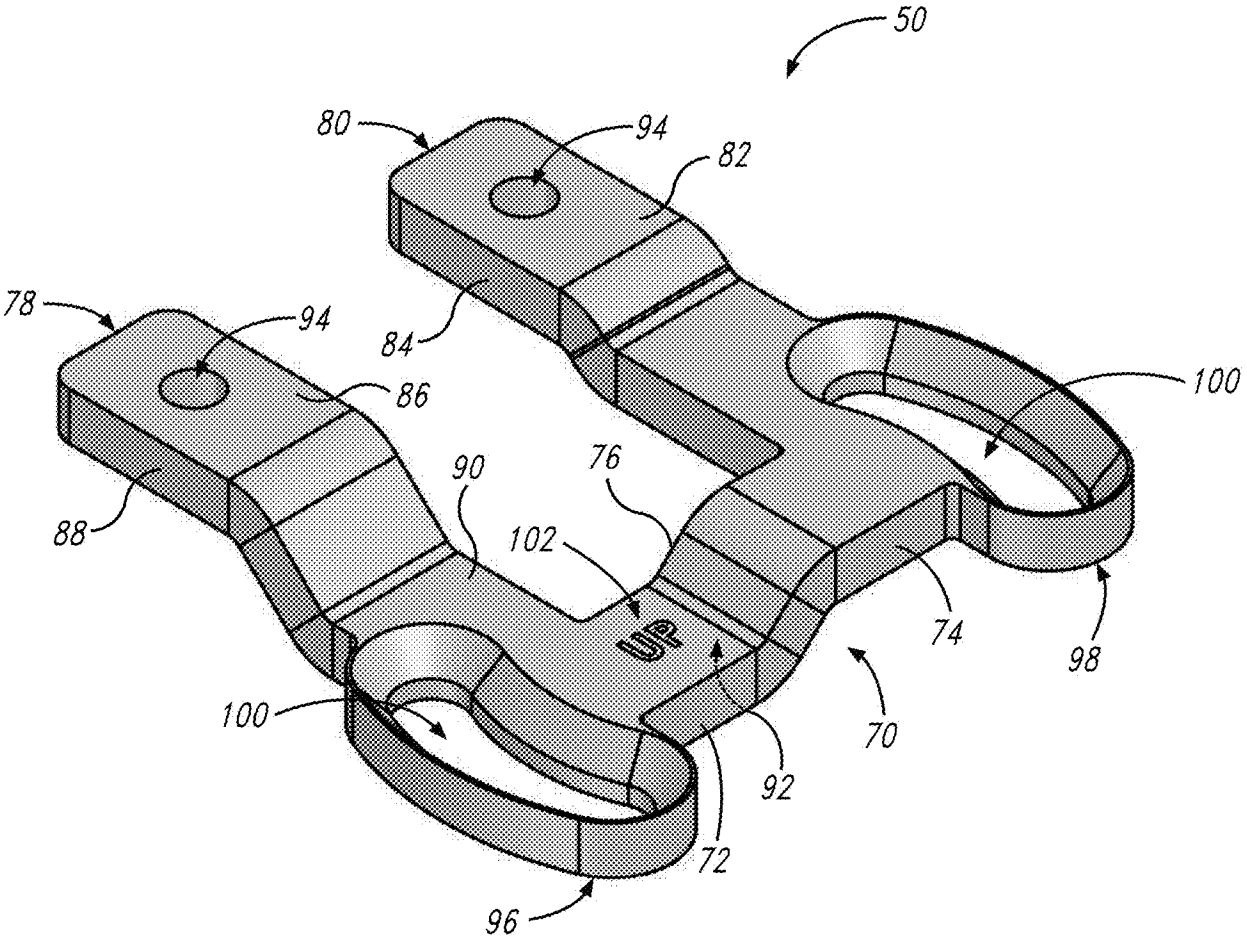
FIG. 5 is an enlarged isometric view of a mounting bracket formed in accordance with the present disclosure.

An implementation of a mounting bracket 50 formed in accordance with the present disclosure is shown in greater detail in FIG. 5. The mounting bracket 50, which is utilized for the top rail 30, includes a base 70 having a first half 72 and second half 74 that is stepped up from the first half with an intermediate member 76. A first arm 78 extends from the first half 72, which is stepped up from the first half 72 of the base 70, and a second arm 80 that extends from the second half 74 with a step up that is less than a distance of step up of the first arm 78 so that a top surface 82 at a distal end 84 of the second arm 80 is coplanar with a top surface 86 at a distal end 88 of the first arm 78.

The second half 74 of the base 70 is stepped up a distance that is equal to a thickness of the base 70, that is, the distance between mutually opposing surfaces 90, 92 of the base 70. The first arm 78 steps up a distance that is equal to the distance the second half 74 of the base 70 steps up from the first half 72 plus a distance the second arm 80 steps up from the second half 74 of the base 70. As will be described in more detail below, the step-up distance of the second half 74 allows the second half 74 of the base 70 to rest on top of a first half of an adjacent mounting bracket on a post, such as for a corner connection. The respective step-up distances of the first and second arms 78, 80 places the top surfaces 86, 82 immediately adjacent to and preferably abutting the bottom 48 of the top rail 30 as described below. An opening 94 is formed in the distal ends 84, 88 to receive a fastener (described below).

The mounting bracket 50 further includes first and second ears 96, 98 extending from the first half 72 and the second half 74 of the base 70, respectively, each ear 96, 98 having an arcuate opening 100 that is preferably counter-bored with sloping sides to receive the head of a fastener in a counter-sunk relationship. Ideally only a first side of the opening is counter bored. The arcuate openings 100 have identical radii of curvature that permit the mounting bracket to rotate clockwise or counterclockwise (as viewed from the top) about the fasteners when attached to a post. The length of the arcuate opening is dependent on the application and the desired range of rotation. Optional indicia 102 on the surface 90 of the first half 72 of the base 70 indicates the orientation of the mounting bracket when it is installed, i.e., "UP" indicates the surface 90 is to be facing away from the top of the post, typically in an upward direction with reference to the earth.

Figure 6:
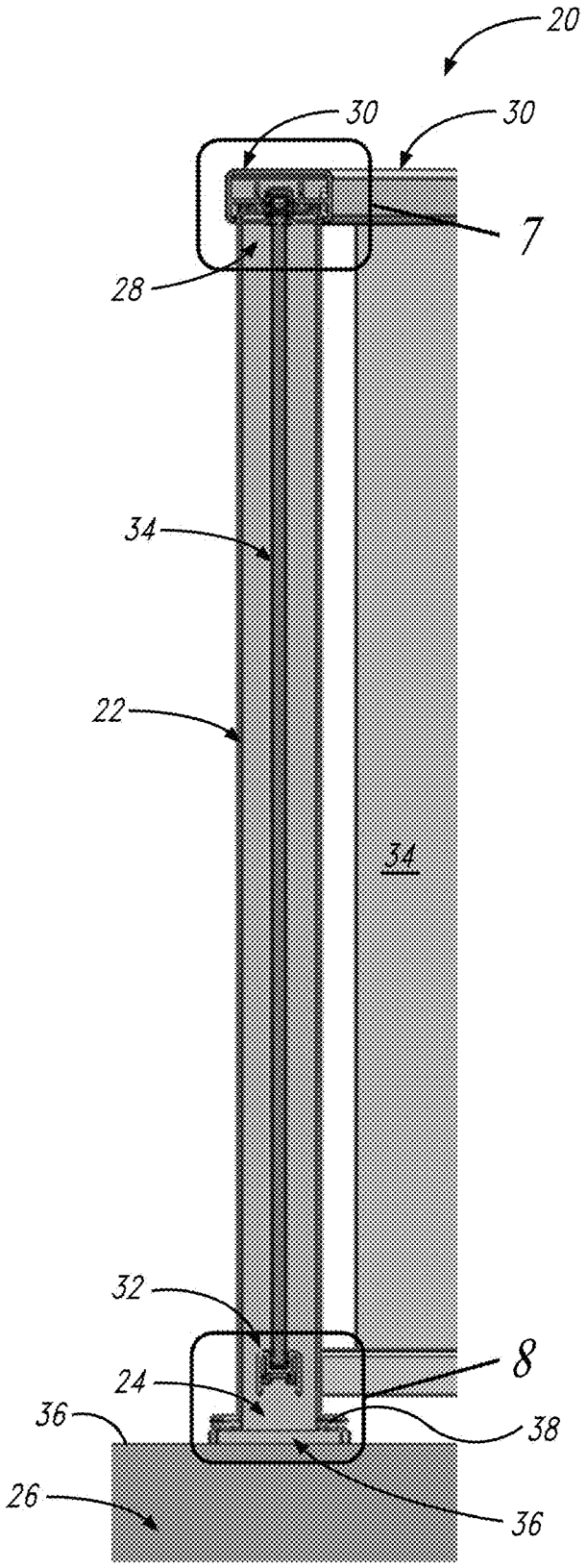
FIG. 6 is a partial cross-sectional view of the assembled flat deck railing system of FIG. 1 showing the top and bottom rail connections.
Figure 7:
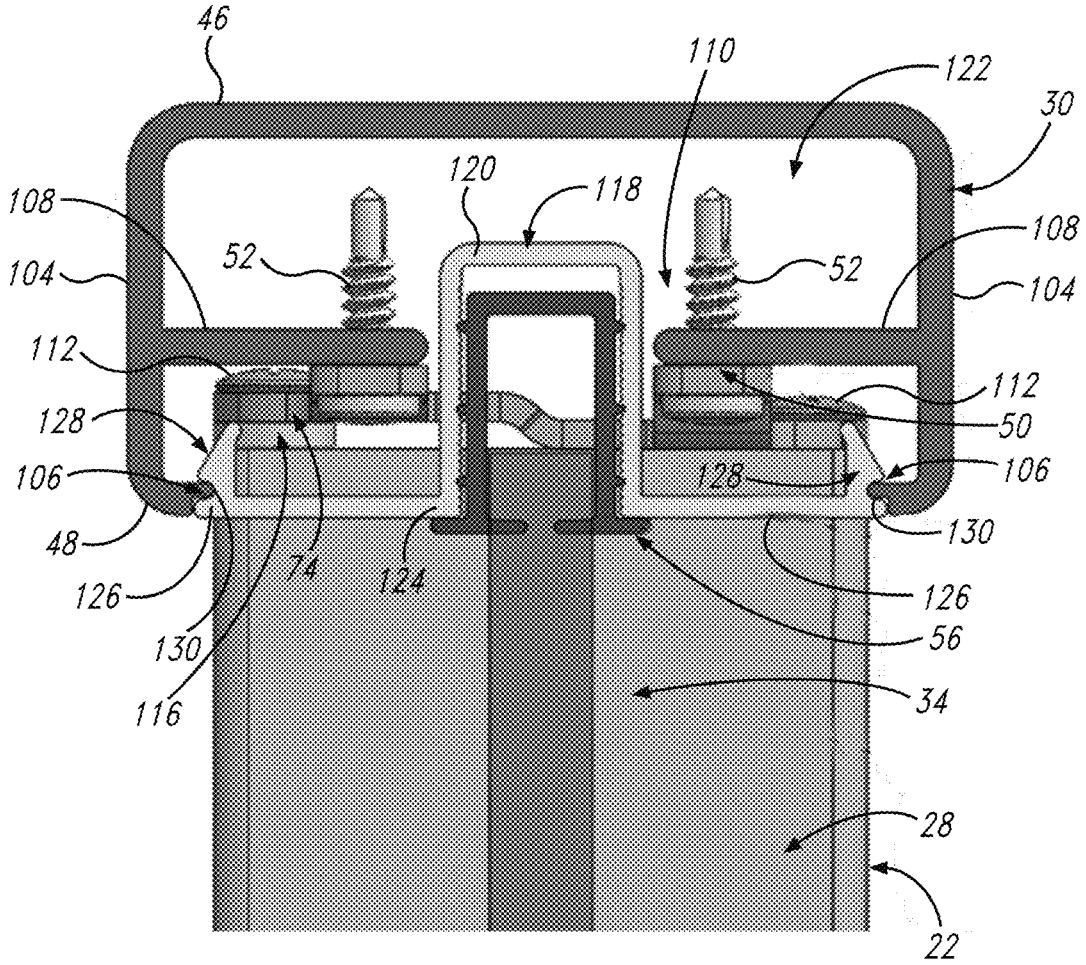
FIGS. 7 and 8 are enlarged partial cross-sectional views of the top and bottom rail connections of FIG. 6.
Figure 8:
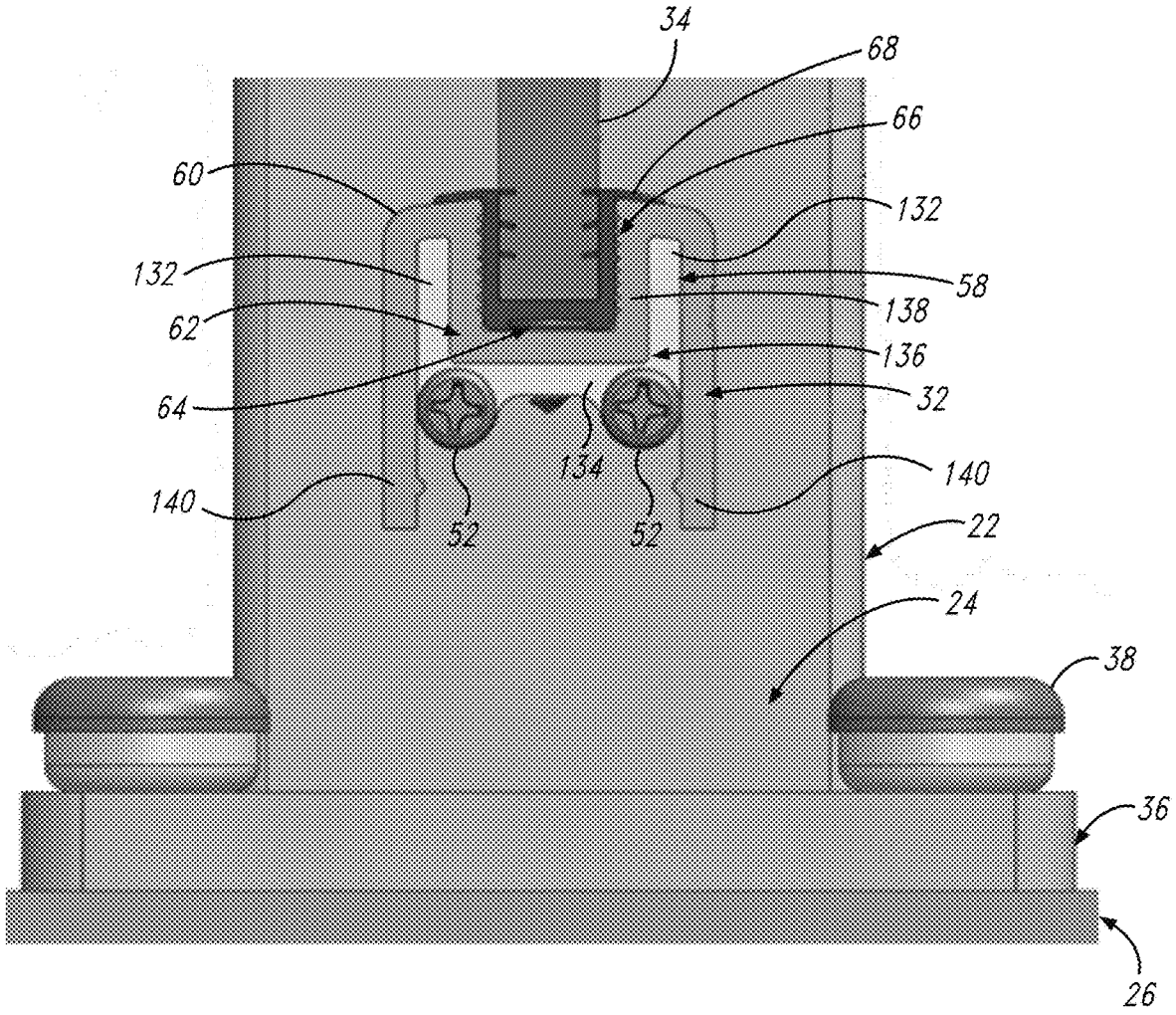

FIGS. 6, 7, and 8 illustrate one installation of the deck mount railing system 20 shown in FIG. 1 and described in some detail with respect to FIGS. 3 and 4. The cross-sectional views of FIGS. 6-8 show more detail about the components and the installation.

As can be seen more clearly in FIG. 7, the top rail 30 has a U-shaped cross-sectional configuration with a pair of opposing sidewalls 104 extending from the top 46 to the bottom 48. The bottom 48 terminates with an inward projecting tab 106 on each side. Located on the interior of the top rail 30 are a pair of inwardly projecting flanges 108 that extend from the sidewalls 104 about one-third of a distance spanning the two opposing sidewalls 104. This leaves a centrally located gap 110 between the two flanges 108. These flanges are preferably of the same thickness as a thickness of the top 46 and sidewalls 104. Ideally the top rail is an extruded part with all the components integrally formed therewith.

The top rail 30 is attached to the mounting bracket 50 with a pair of fasteners 52 extending through the openings 94 in the first and second arms 78, 80 of the mounting bracket 50 and threadably engaged with a respective flange 108 of the top rail 30. A second pair of fasteners 112 extends through the arcuate openings 100 of the mounting bracket 50 and are threadably engaged with openings 114 (shown in FIG. 3) in the top of the post 22. A washer 116 is positioned under the stepped-up second half 74 of the base 70 to keep the mounting bracket 50 and the attached top rail 30 level with respect to the post 22.

The top rail infill 54 is shown in cross section in FIG. 7 to have a substantially inverted U-shaped channel 118 sized and shaped to be received through the centrally located gap 110 between the two flanges 108 of the top rail 30. A closed end 120 of the channel 118 projects up into a hollow interior 122 of the top rail 30 and an open end 124 of the channel 118 has two outwardly extending legs 126 at substantially a right angle to the channel 118. Each leg 126 is solid and ideally is integrally formed with the channel 118 and further includes a terminal end 128 having a groove 130 that is sized and shaped to receive the projecting tab 106 on the top rail 30 in snapping engagement. Thus, after the top rail 30 is attached to the mounting bracket 50 and in turn to the post 22, the top rail infill 54 is placed into position under the top rail 30 with the U-shaped channel 118 extending between the flanges 108, and the tabs 106 from the top rail are snapped into place in the respective groove 128 on the associated leg 126.

As will be appreciated from the cross-sectional view in FIG. 7, when the infill 54 is in place on the top rail 30, the two laterally extending legs 126 present a visual barrier to the fasteners 52, mounting bracket 50, and fasteners 112. In addition, the top rail infill 54 provides a platform for holding the glass panel 34 in place via the U-shaped channel 118. Ideally, the U-shaped channel 118 is lined with the resilient, removable top rail insert 56 that remains in place with a friction fit. The insert 56 has a U-shaped cross-sectional configuration with an interior sized and shaped to receive the glass panel 34 with an interference fit. The insert 56 and the infill channel 118 are sized to have a depth that allows the glass panel to be slid up into the insert and facilitate placement of the glass panel into the bottom rail 32.

FIG. 8 illustrates the assembly of the bottom rail 32 to the post 22 using the rail connector block 58 affixed to the post 22. The rail connector block 58 has two spaced-apart and upward projecting walls 132 from a base wall 134 that cooperate to form a wide channel 136 sized and shaped to receive a U-shaped longitudinal center section 138 of the bottom rail 32. The bottom rail 32 also has outside walls 140 on each side that extend beyond the U-shaped center section 138 and below the fasteners 52 to provide a visual site barrier to the fasteners 52. These walls 140 also cooperate with the center section 138 to bear against and hold the bottom rail to the upward projecting walls 132 on the rail connector block 58. The fastener 64 extending through a bottom wall of the U-shaped center section 138 and threadably engaged with the base wall 134 of the rail connector block can be used to secure the bottom rail 32 to the rail connector block 58.

The top side 60 of the bottom rail 32 has the channel 66 formed in the longitudinal center section 138 that is sized and shaped to receive a resilient, U-shaped bottom rail insert 68. Like the top rail insert 56, the bottom rail insert 68 has a friction fit with the bottom rail channel 66 and is sized and shaped to hold the glass panel 34 with an interference fit. No fasteners or adhesives are used to hold the respective inserts 56, 68 in place on the top and bottom rails 30, 32, respectively, or on the glass panel 34.

Figure 9:
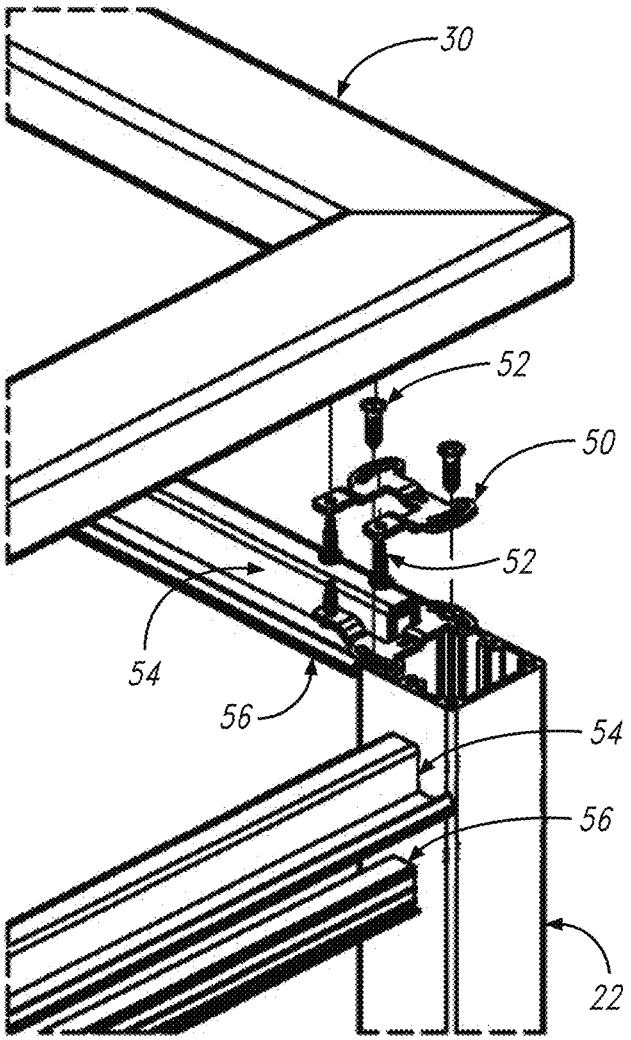
FIG. 9 is an exploded isometric view of a corner top rail connection to a post for the railing systems of FIGS. 1 and 2.
Figure 10:
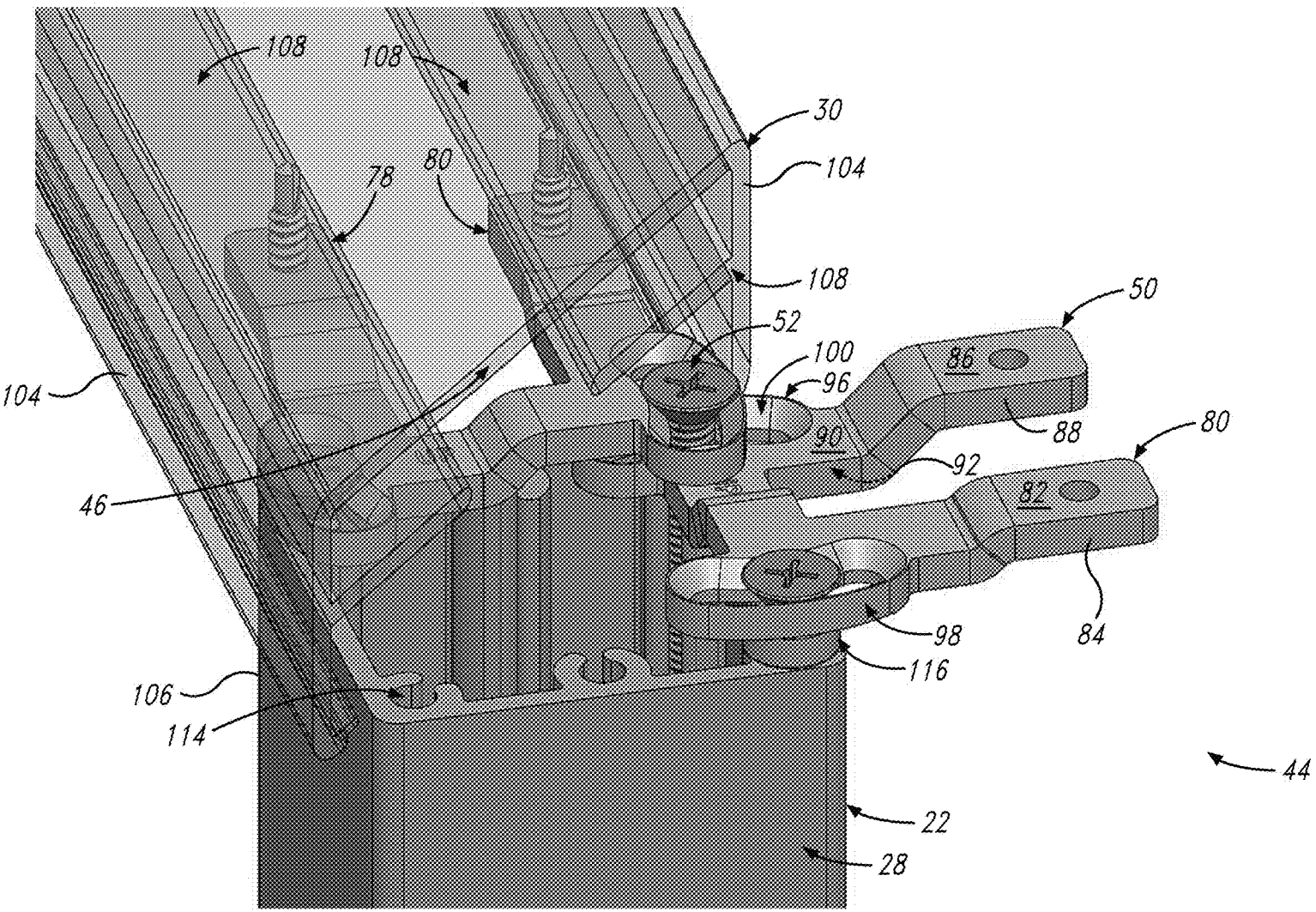
FIG. 10 is an enlarged partial cutaway isometric view of an assembled top rail corner connection of the railing systems of FIG. 9.
Figure 11:
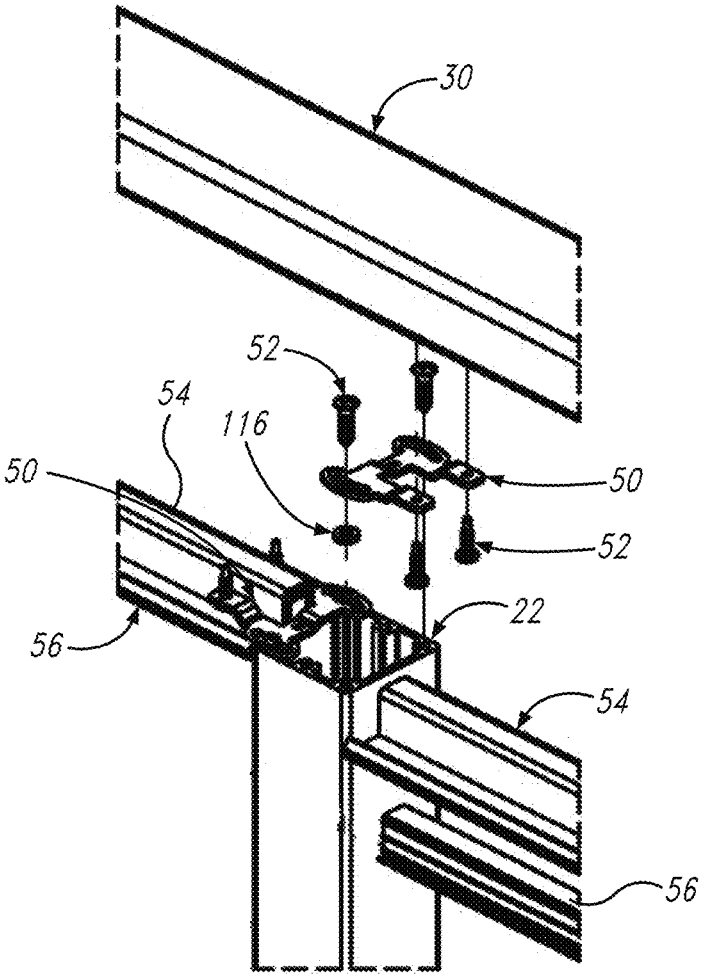
FIG. 11 is an exploded view of a continuous straight top rail connection to a post for the railing systems of FIGS. 1 and 2.

It will be appreciated that FIG. 6 shows a corner connection having the single post 22, and the orthogonal glass pane 34 will be attached to the same post in the same manner as described above. FIG. 9 is an exploded view of this corner connection and FIG. 10 is a partial cutaway of the assembled components in which two top rails 30 are joined to a single post 22 at a substantially 90 degree angle by two stacked mounting brackets 50. It will be appreciated that for other angles the mounting brackets 50 can be rotated relative to the post 22 and to each other via the arcuate openings 100. The range of rotation is determined by the length of the arcuate opening 100, and generally is in the range of 45 degrees from stop to stop. In other words the two top rails 30 can be attached to the posts at an angle of 90 degrees to each other or at angles up to 135 degrees to each other. FIG. 10 is an exploded view of a continuous top rail connection in which the top rail 30 is a single piece that is attached to the intermediate supporting post 22 with two opposing mounting brackets 50.

Figure 12:
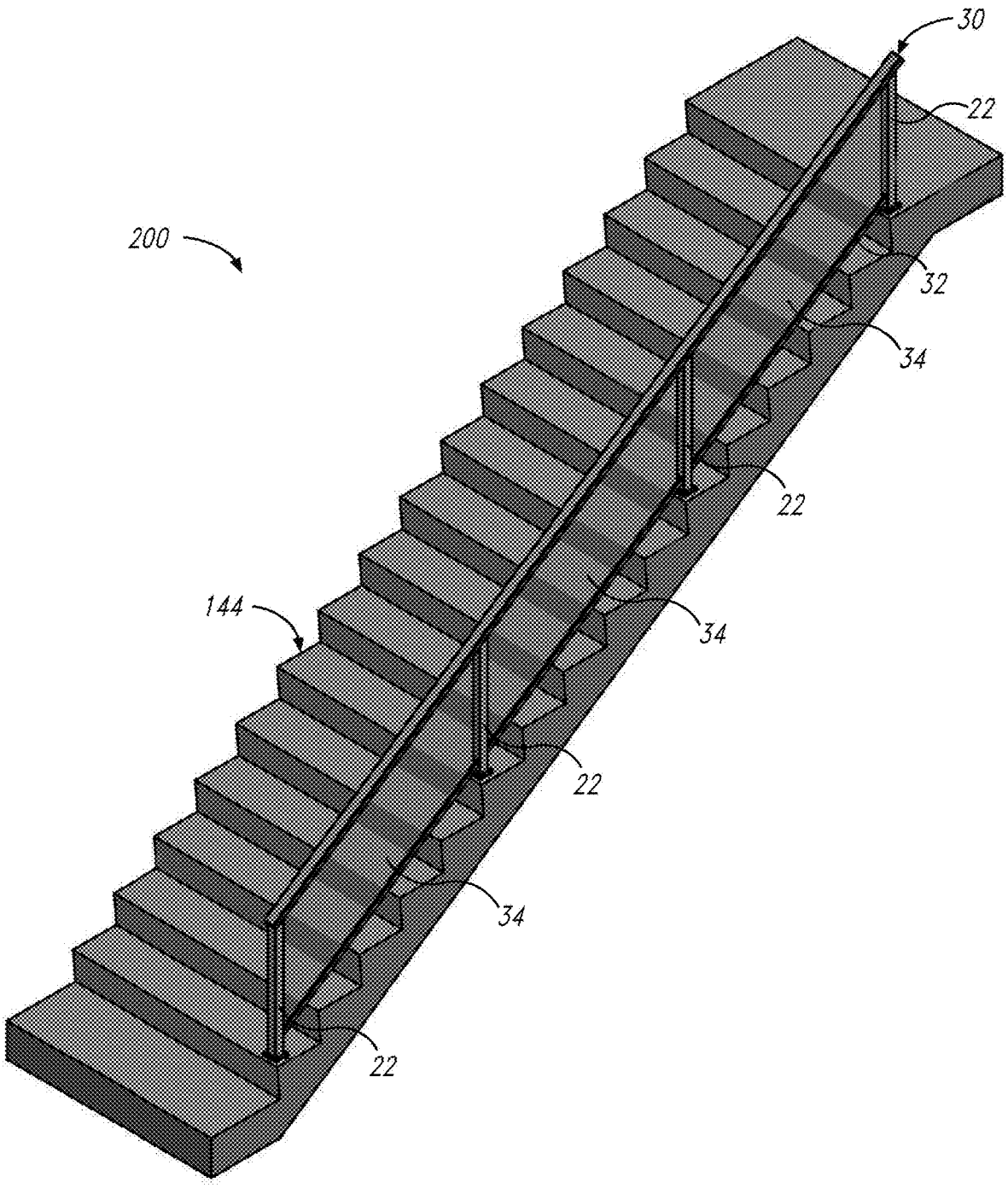
FIG. 12 is an isometric view of a deck mount stair railing system formed in accordance with the present disclosure.
Figure 13:
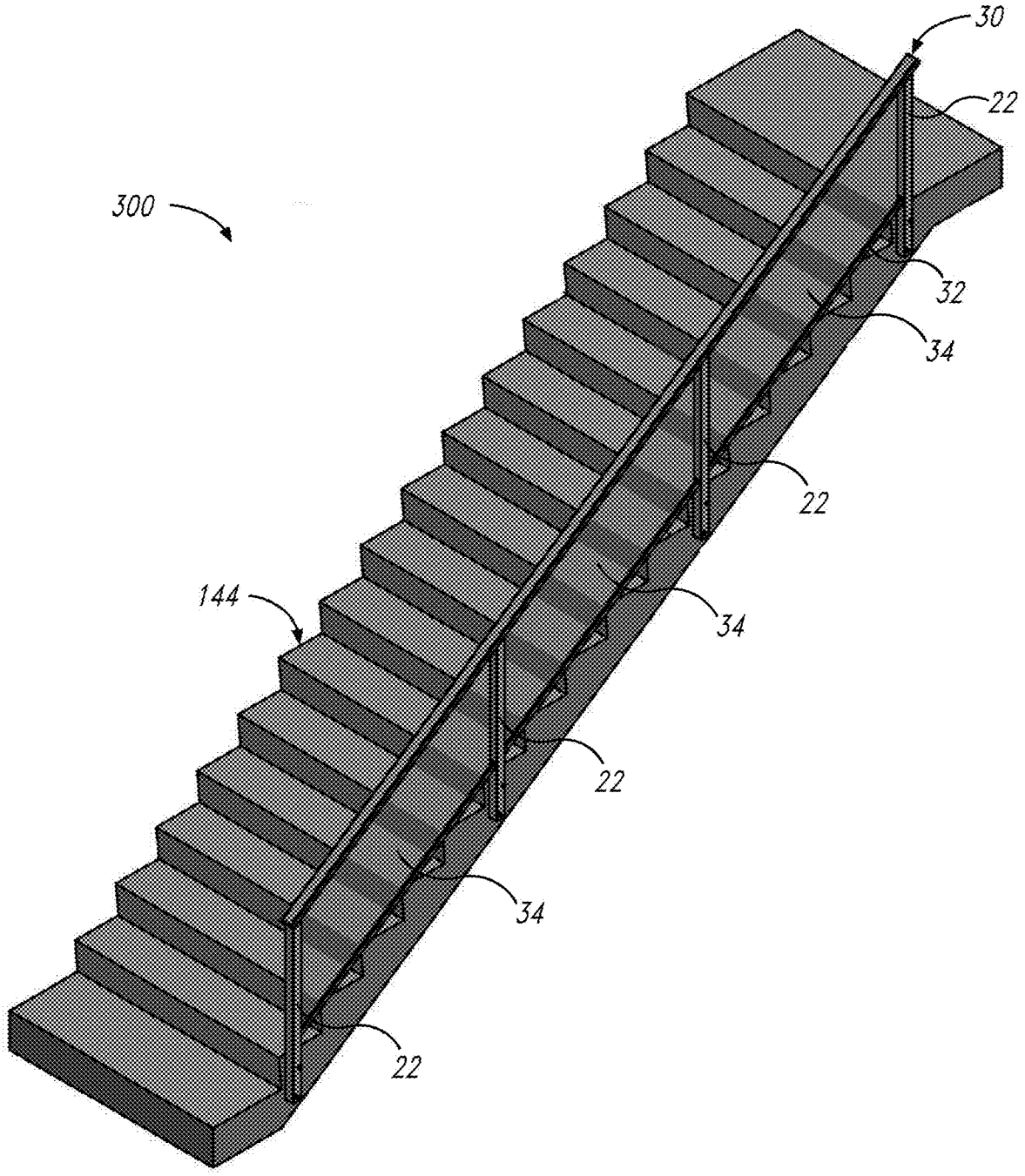
FIG. 13 is an isometric view of a fascia mount stair railing system formed in accordance with the present disclosure.
Figure 14:
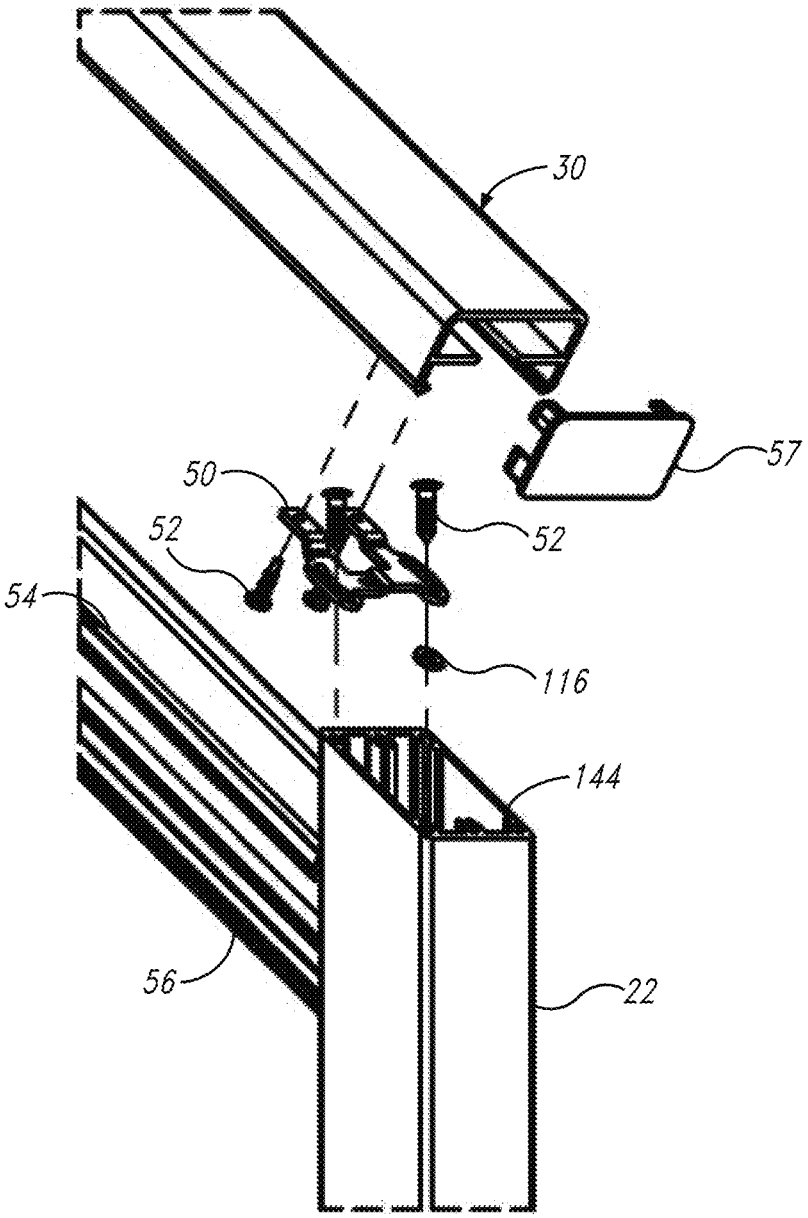
FIG. 14 is an exploded isometric view of a top rail end connection for the stair railing systems of FIGS. 12 and 13.
Figure 15:
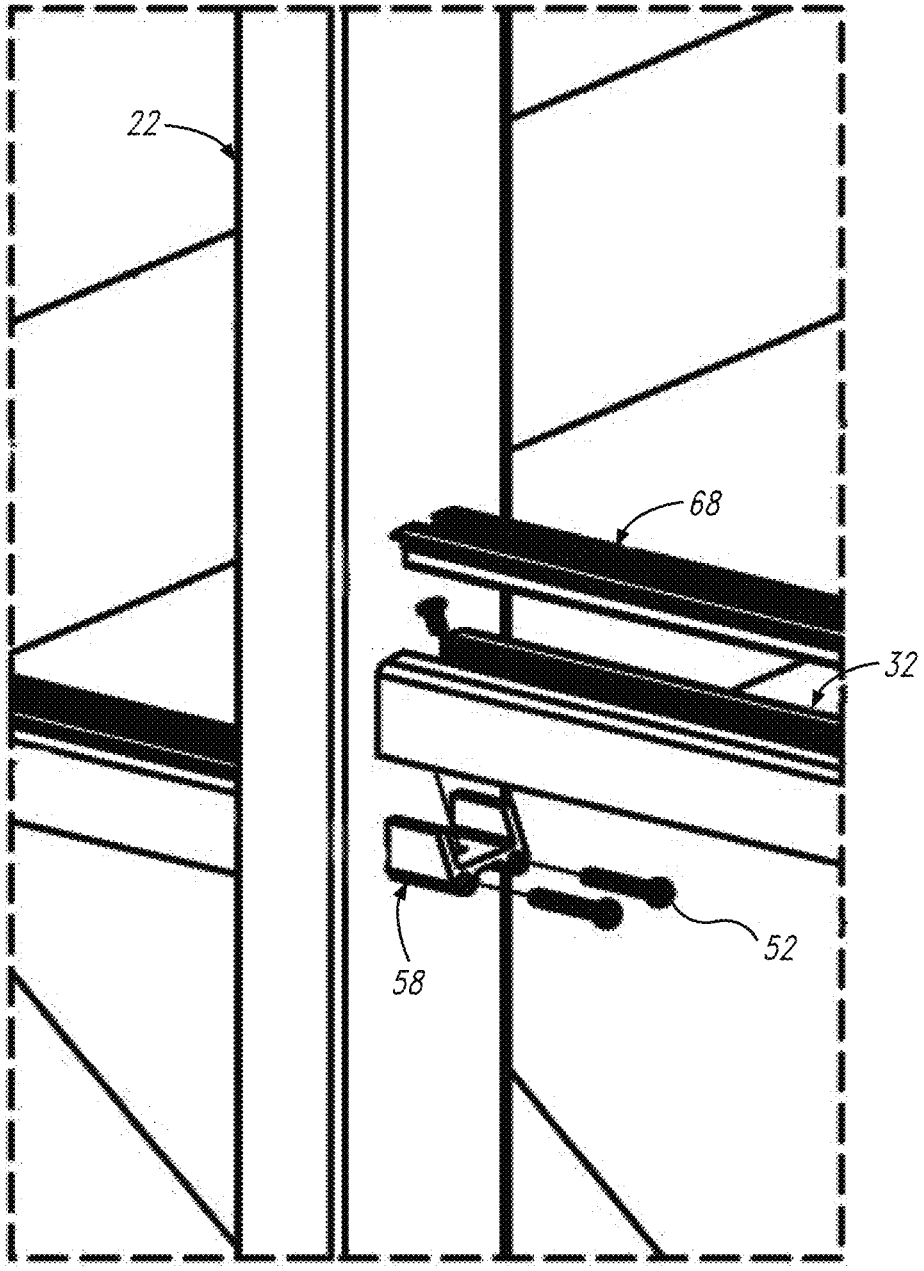
FIG. 15 is an exploded isometric view of a bottom rail connection to a top post for the stair railing systems of FIGS. 12 and 13.

FIG. 12 is an isometric view of a deck mount stair railing system 200, and FIG. 13 is an isometric view of a fascia mount stair railing system 300 both in connection with stairs 144 that may be of any material, such as concrete, wood, metal, and composite materials. FIG. 14 is an exploded isometric view of a top rail end connection for the stair railing systems 200, 300 of FIGS. 12 and 13. Components previously described will use the same reference numbers. In these stairway implementations, the deck mount and fascia mountings are essentially the same as described above in FIGS. 1 and 2, respectively. With respect to the top rail 30, as shown in FIG. 14, a top of the post 22 is cut at an angle to accommodate the elevation of the stairs 144. In all other respects the mounting of the top rail 30 and remaining components is the same as described above. Similarly, the bottom rail 32 is attached to the post 22 using the rail connector block 58, except the block 58 may have an end face cut at an angle to accommodate the elevation of the stairs 144. More particularly, the block at the top post on the stairs would be cut at an angel to permit the bottom rail 32 to angle downward as shown in FIG. 15.

With respect to the fasteners, these are chosen based on a variety of factors particular to each application. Generally, these screws are preferably self-drilling to eliminate the need for threaded parts. The mounting bracket 50 can be a ¼"-20 flat head screw TF (type F thread cutting). The top rail 30 to mounting bracket 50 joint is fastened using a pan head self-drilling screw.

The various implementations described above can be combined to provide further implementations. Aspects of the present disclosure can be modified, if necessary to employ concepts of the various patents, applications and publications cussed herein or to provide yet further implementations. It is to be understood that other forms of barriers may be used besides a glass panel, as discussed above.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A railing system that holds glass panels, comprising:

a plurality of posts, each post of the plurality of posts having a first end capable of mounting to a support and a second end;

a rail having a top side and an opposing bottom side;

a mounting bracket having a base with a first half and a second half and a pair of spaced apart first and second arms integrally formed with and extending from the base, the first arm extending from the first half of the base and the second arm extending from the second half of the base in spaced parallel relationship to the first arm, the second half of the base offset from the first half of the base by a first offset distance, the second arm offset from the second half of the base by a second offset distance, and the first arm offset from the first half of the base by a third offset distance that is a sum of the first offset distance and the second offset distance so that a distal end of the first arm is coplanar with a distal end of the second arm, first and second ears extending from the first half and the second half of the base respectively, each of the first and second ears having an arcuate opening, the mounting bracket sized and shaped to be mounted to a top of a first post of the plurality of posts via a first fastener in at least one of the arcuate openings, the first and second arms extending from the base each having an opening to receive a second fastener for threadable engagement with the opposing bottom side of the rail;

a top rail infill capable of attaching to the bottom side of the top rail and concealing the second fasteners that attach the mounting bracket to the bottom side of the top rail, the top rail infill having a channel;

a vinyl liner capable of attachment in the channel of the top rail infill and sized and shaped to receive an edge of a glass panel;

a rail connector block sized and shaped to be attached to the post with at least one fastener, the rail connector block having a base wall and a pair of spaced apart extensions projecting from the base wall; and a bottom rail having a top side and an opposing bottom side, the top side having a channel sized and shaped to receive a bottom edge of the glass, and the bottom side having a pair of channels sized and shaped to be received over the pair of spaced apart extensions on the rail connector block and support the bottom rail on the mounting block, the bottom rail having a skirt extending past the bottom side of the bottom rail to conceal the at least one fastener when the railing system is assembled.

2. The railing system of claim 1, further comprising a washer sized and shaped to be received under the second half of the base to support the second half of the base on the top of the post.

3. The railing system of claim 1 wherein the top rail infill extends a length of the top rail and the vinyl insert extends a length of the top rail infill.

4. A railing mounting system for use with a plurality of posts having a first end capable of mounting to a support and a second end, and at least one rail having a top side and an opposing bottom side, the mounting system comprising:

a mounting bracket having a base with a first half and a second half and a pair of spaced apart first and second arms extending from the base, the first arm extending from the first half of the base and the second arm extending from the second half of the base in spaced parallel relationship to the first arm, the second half of the base offset from the first half of the base by a first offset distance, the second arm offset from the second half of the base by a second offset distance, and the first arm offset from the first half of the base by a third offset distance that is a sum of the first offset distance and the second offset distance so that a distal end of the first arm is coplanar with a distal end of the second arm, first and second ears extending from the first half and the second half of the base respectively, each ear of the first and second ears having an arcuate opening, the mounting bracket sized and shaped to be mounted to the top of a first post of the plurality of posts via a fastener in at least one of the arcuate openings, the first and second arms extending from the base each having an opening to receive a fastener for threadable engagement with the opposing bottom side of the rail.

5. The mounting system of claim 4 further comprising a top rail infill capable of attaching to the opposing bottom side of the top rail and concealing the fastener that attaches the mounting bracket to the opposing bottom side of the top rail, the top rail infill having a channel.

6. The mounting system of claim 5, further comprising a vinyl liner capable of attachment in the channel of the top rail infill and sized and shaped to receive an edge of a glass panel.

7. The mounting system of claim 6, further comprising a rail connector block sized and shaped to be attached to the post with at least one fastener, the rail connector block having a base wall and a pair of spaced apart extensions projecting from the base wall.

8. The mounting system of claim 7, further comprising a bottom rail having a top side and an opposing bottom side, the top side having a channel sized and shaped to receive a bottom edge of the glass, and the bottom side having a pair of channels sized and shaped to be received over the pair of spaced apart extensions on the rail connector block and support the bottom rail on the rail connector block, the bottom rail having a skirt extending past the bottom side of the bottom rail to conceal the at least one fastener when the railing system is assembled.

9. The mounting system of claim 8 wherein the top rail infill extends a length of the top rail and the vinyl insert extends a length of the top rail infill.

10. The mounting system of claim 4, further comprising a washer sized and shaped to be received under the second half of the base to support the second half of the base on the top of the post.

* * * * *